US008432388B2

(12) United States Patent
Koh

(10) Patent No.: US 8,432,388 B2
(45) Date of Patent: Apr. 30, 2013

(54) ORGANIC LIGHT EMITTING DISPLAY DEVICE

(75) Inventor: Byung-Sik Koh, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 129 days.

(21) Appl. No.: 12/976,855

(22) Filed: Dec. 22, 2010

(65) Prior Publication Data

US 2011/0279430 A1 Nov. 17, 2011

(30) Foreign Application Priority Data

May 17, 2010 (KR) ..... 10-2010-0046008

(51) Int. Cl.
*G09G 3/30* (2006.01)

(52) U.S. Cl.
USPC ..... 345/211; 345/76

(58) Field of Classification Search ..... None
See application file for complete search history.

(56) References Cited

U.S. PATENT DOCUMENTS

2005/0052366 A1* 3/2005 Kim ..... 345/76
2007/0229411 A1* 10/2007 Choi ..... 345/76
2009/0219232 A1 9/2009 Choi

FOREIGN PATENT DOCUMENTS

KR 10-0581804 B1 5/2006
KR 10-2006-0073681 6/2006
KR 10-0646989 B1 11/2006
KR 10-0698703 3/2007
KR 10-2008-0095799 10/2008
KR 10-2009-0093020 9/2009

OTHER PUBLICATIONS

KIPO Office Action dated Oct. 10, 2011 for Korean Priority Patent Application No. 10-2010-0046008, 4 pages.
KIPO Office action dated May 24, 2012 in priority application No. KR 10-2010-0046008 (4 pages).
KIPO Notice of Allowance dated Nov. 28, 2012, for Korean priority Patent application 10-2010-0046008, (1 page).
Korean Patent Abstracts for Korean Publication 1020060012930, dated Feb. 9, 2006, corresponding to Korean Patent 10-0581804 listed above.

* cited by examiner

*Primary Examiner* — William Boddie
*Assistant Examiner* — Carolyn R Edwards
(74) *Attorney, Agent, or Firm* — Christie, Parker & Hale, LLP

(57) ABSTRACT

An organic light emitting display device includes: a scan driver for supplying scan signals to scan lines and an emission control signal to an emission control line during a scan period; a data driver for supplying data signals to data lines; a second power supply supplying a second power at a high voltage level during the scan period and at a low voltage level during an emission period; and a plurality of pixels located at crossing regions of the scan lines and the data lines, the pixels controlling the amount of current supplied through organic light emitting diodes (OLEDs), each of the pixels located in an i-th horizontal line including: a second transistor having a second electrode coupled with an OLED; and a first transistor coupled between the second transistor and a data line and turned on when a scan signal is supplied to the i-th scan line.

7 Claims, 5 Drawing Sheets

ORGANIC LIGHT EMITTING DISPLAY DEVICE

CROSS-REFERENCE TO RELATED APPLICATIONS

This application claims priority to and the benefit of Korean Patent Application No. 10-2010-0046008, filed on May 17, 2010, in the Korean Intellectual Property Office, the entire content of which is incorporated herein by reference.

BACKGROUND

1. Field

Embodiments of the present invention relate to an organic light emitting display device, particularly an organic light emitting display device operating in a concurrent (or simultaneous) emission method.

2. Discussion of Related Art

Recently, a variety of flat panel displays that reduce disadvantages of cathode ray tubes, such as weight and volume, have been developed. Typical flat panel displays include liquid crystal displays, field emission displays, plasma display panels, organic light emitting display devices, etc.

An organic light emitting display device is a flat display device that displays an image using organic light emitting diodes that emit light by the recombination of electrodes and holes and has high response speed and low power consumption.

In general, organic light emitting display devices are classified into passive matrix organic light emitting display devices (PMOLED) or active matrix organic light emitting display devices (AMOLED), in accordance with the methods of driving the organic light emitting diodes.

An active matrix organic light emitting display device includes a plurality of scan lines, a plurality of data lines, a plurality of power source lines, and a plurality of pixels coupled with the lines and arranged in a matrix. The pixel includes an organic light emitting diode, a driving transistor for controlling the amount of current supplied to the organic light emitting diode, a switching transistor for transmitting a data signal to the driving transistor, and a storage capacitor for maintaining voltage of the data signal.

The active matrix organic light emitting display device has low power consumption, but may have a display that is not uniform because the magnitude of a current flowing through an organic light emitting element may vary due to variations in a voltage difference between the gate and the drain (or the gate and the source) of a driving transistor that drives the organic light emitting element, that is, a threshold voltage (or a threshold voltage difference) of the driving transistor.

That is, properties of the transistors disposed in the pixels are changed by variables in the manufacturing process, and accordingly, the threshold voltages of the driving transistors vary between the pixels. Therefore, a compensating circuit that can compensate the threshold voltage of the driving transistors may be additionally formed to remove the non-uniformity between the pixels.

The compensating circuit, however, additionally includes a plurality of transistors and capacitors, and signal lines controlling these transistors. Therefore, the pixel including the compensating circuit has a problem in that the aperture ratio decreases and the possibility of defect increases.

SUMMARY

An aspect of an embodiment of the present invention is directed toward a pixel including five transistors and two capacitors.

An aspect of an embodiment of the present invention is directed toward an organic light emitting display device that can display an image with desired luminance, regardless of the threshold voltage of driving transistors, by operating pixels in a concurrent (or simultaneous) emission method.

According to an embodiment of the present invention an organic light emitting display device includes: a scan driver for supplying a plurality of scan signals to a plurality of scan lines and for supplying an emission control signal to an emission control line during a scan period in one frame; a data driver for supplying a plurality of data signals to a plurality of data lines in synchronization with the scan signals; a second power supply for supplying a second power at a high voltage level during the scan period and for supplying the second power at a low voltage level during an emission period of one frame period; and a plurality of pixels at crossing regions of the scan lines and the data lines and for controlling the amount of current supplied to the second power supply from a first power supply through organic light emitting diodes, each of the pixels along an i-th horizontal line, wherein i is a natural number, including: a second transistor having a second electrode directly coupled with an anode electrode of a corresponding organic light emitting diode of the organic light emitting diodes; a first transistor coupled between a first electrode of the second transistor and a corresponding data line of the data lines, the first transistor being configured to be turned on when a scan signal is supplied to an i-th scan line; and a third transistor coupled between the second electrode of the second transistor and the gate electrode of the second transistor, the third transistor being configured to be turned on when a scan signal is supplied to the i-th scan line.

The voltage of the second power supply may be set at a high voltage level such that current does not flow in the organic light emitting diodes. The emission control line may be coupled to all of the pixels. The scan driver may be configured to not supply the emission control signal to the emission control line during the emission period. Each of the pixels along the i-th horizontal line may further include: a fourth transistor coupled between a gate electrode of the second transistor and an initialization power supply, the fourth transistor being configured to be turned on when a scan signal is supplied to an i−1-th scan line of the scan lines; a fifth transistor coupled between the first electrode of the second transistor and the first power supply, the fifth transistor being configured to be turned off when the emission control signal is supplied to the emission control line; a storage capacitor coupled between the gate electrode of the second transistor and the first power supply; and a boosting capacitor coupled between the gate electrode of the second transistor and the i-th scan line. The initialization power supply may be configured to supply a voltage lower than a voltage of a data signal of the data signals.

According to embodiments of the present invention, it is possible to compensate for the threshold voltage of a driving transistor using pixels including four transistors and two capacitors. Further, embodiments of the present invention can more easily display a 3D image because it operates in a concurrent (or simultaneous) emission method.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
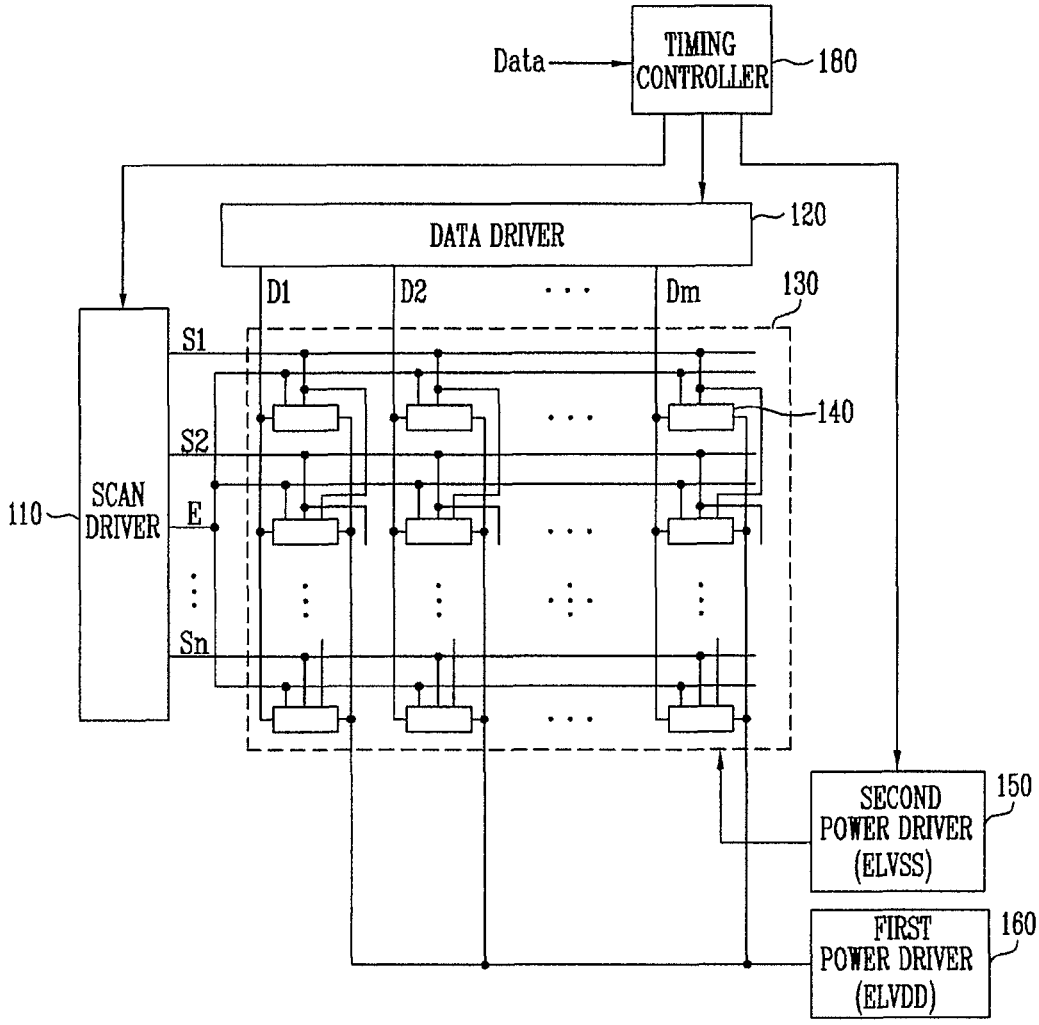
FIG. 1 is a block diagram illustrating an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Also, like reference numerals refer to like elements throughout.

Exemplary embodiments for those skilled in the art to easily implement the present invention are described in detail with reference to FIGS. 1 to 6.

FIG. 1 is a diagram illustrating an organic light emitting display device according to an embodiment of the present invention.

Referring to FIG. 1, an organic light emitting display device according to an embodiment of the present invention includes: a pixel unit (or display unit) 130 including pixels 140 coupled with scan lines S1 to Sn, an emission control line E, and data lines D1 to Dm; a scan driver 110 for supplying scan signals to the scan lines S1 to Sn and for supplying an emission control signal to the emission control line E; a data driver 120 for supplying data signals to the data lines D1 to Dm; a first power driver 160 for supplying power of a first power supply ELVDD to the pixels 140; a second power driver 150 for supplying a power of a second power supply ELVSS to the pixels 140; and a timing controller 180 for controlling the scan driver 110, the data driver 120, and the second power driver 150.

The scan driver 110 sequentially supplies scan signals to the scan lines S1 to Sn for the scan period of one frame period. Further, the scan driver supplies an emission control signal to the emission control line E during a scan period and does not supply an emission control signal during an emission period (e.g., during a period other than the scan period).

In this configuration, the emission control signal is set at a voltage level that allows a transistor to be turned off, and the scan signal is set at a voltage level that allows the transistor to be turned on. For example, when the scan signal is set at a low-level voltage, the control signal is set at a high-level voltage.

The emission control line E is coupled with all of the pixels 140, and the pixels 140 are set in a non-emission state during the period when the emission control signal is supplied. That is, in embodiments of the present invention, the pixels 140 are set in the non-emission state by supplying an emission control signal during the scan period of one frame period, and the pixels 140 are set in an emission state by stopping the supply of the emission control signal during the emission period (e.g., in a period other than the scan period) of one frame period.

The data driver 120 supplies data signals to the data lines D1 to Dm in synchronization with the scan signals supplied to the scan lines S1 to Sn.

The pixel unit 130 includes the pixels 140 located at crossing regions of the scan lines S1 to Sn and the data lines D1 to Dm. The pixels 140 are supplied with power from the first power supply ELVDD and the second power supply ELVSS. The pixels 140 are charged with voltages corresponding to the data signals supplied during the scan period and produce light in accordance with the data signals during the emission period. The pixels 140 control the currents supplied to a second power source ELVSS through the organic light emitting diodes from a first power source ELVDD in accordance with the data signals during the emission period.

A pixel 140 located in an i-th (i is a natural number) horizontal line is coupled with an i-th scan line and an i−1-th scan line Si−1. For this configuration, the pixels 140 located in the first horizontal line may be additionally coupled with a 0-th scan line S0.

The first power driver 160 supplies a power of the first power supply ELVDD to the pixels 140. The first power supply ELVDD supplies power having a voltage such that current can flow in the organic light emitting diodes included in the pixels 140.

The second power driver 150 supplies a power of the second power supply ELVSS to the pixels 140. The second power generator 150 supplies a high voltage level power of the second power supply ELVSS during the scan period and supplies a low voltage level power of the second power supply ELVSS during the emission period. When the voltage of the second power supply ELVSS is set at a high voltage level (e.g., the same voltage as the first power supply ELVDD), current does not flow in the organic light emitting diode, and when the voltage of the second power supply ELVSS is set at a low voltage level, current can flow in the organic light emitting diodes.

Figure 2:
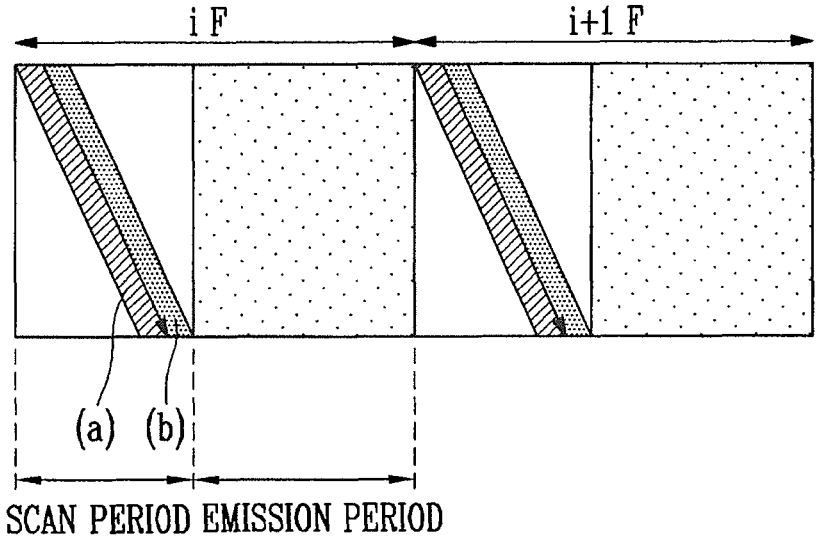
FIG. 2 is a diagram illustrating two frame periods of an embodiment of the present invention.

FIG. 2 is a diagram illustrating two frame periods according to an embodiment of the present invention.

Referring to FIG. 2, the organic light emitting display device according to an embodiment of the present invention operates in a concurrent (or simultaneous) emission method. In general, the driving method can be classified in to a progressive emission method or a concurrent (or simultaneous) emission method. The progressive emission method includes sequentially (or progressively) supplying data to horizontal lines of pixels and sequentially emitting light by using pixels of each horizontal line in the same order that the data was supplied.

The concurrent (or simultaneous) emission method includes sequentially (or progressively) supplying data to horizontal lines of pixels and concurrently (or simultaneously) emitting light by using pixels after the data is supplied to all of the pixels. According to one embodiment of the present invention, when operating in the concurrent (or simultaneous) emission method, one frame is divided into a scan period and an emission period.

The pixels 140 are charged with voltages corresponding to the data signals during the scan period. For this configuration, the scan signals are sequentially supplied to the scan lines S1 to Sn during the scan period, and the data signals are supplied to the pixels 140 selected by the scan signals. The pixels 140 are set in the non-emission state during the scan period. The scan period may be divided into a reset period (a) when the gate electrodes of the driving transistors included in the pixels 140 are initialized, and a charge period (b) when they are charged at voltages corresponding to the data signals.

The pixels 140 control the amount of current flowing to the organic light emitting diode in accordance with the data signals charged during the scan period. That is, the pixels 140 produce light with a luminance (e.g., a predetermined luminance) in accordance with the data signals.

Embodiments of the present invention having this configuration may be used to easily implement a three-dimensional (3D) display using a pair of shutter spectacles because the non-emission period (e.g., the scan period) and the emission period are clearly separated in terms of time.

The 3D display using a pair of shutter spectacles alternately outputs left-eye and right-eye images for each frame. A user wears "shutter spectacles", of which the left-eye and right-eye transmittances switch in the range of 0% to 100%. The shutter spectacles alternately supply the left-eye image and the right-eye image to the left eye and the right eye, respectively, such that the user can recognize a stereoscopic image.

Figure 3:
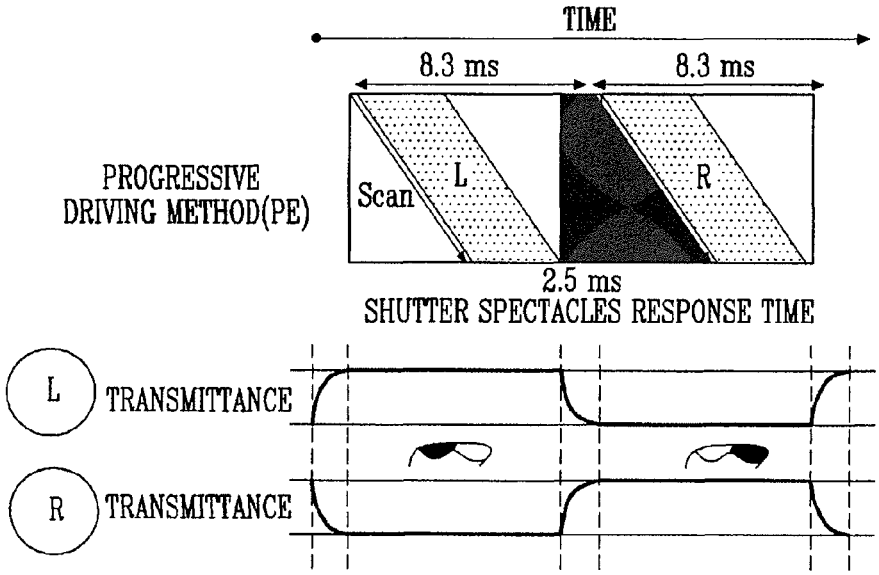
FIG. 3 is a diagram illustrating an example of an operation of a 3D display using a pair of shutter spectacles according to a progressive emission method.

FIG. 3 is a diagram illustrating an example of an operation of a 3D display using a pair of shutter spectacles according to a progressive emission method.

Referring to FIG. 3, emission should be stopped for the response time of the shutter spectacles (e.g., 2.5 ms) in order to prevent cross talk between the left-eye/right-eye images when a screen is outputted by the progressive emission method. That is, a non-emission period is additionally provided for at least the response time of the shutter spectacles between the frame (an i-th frame, where i is a natural number) outputting the left-eye image and the frame (an i+1th frame) outputting the right-eye image. However, this decreases the emission duty ratio.

Figure 4:
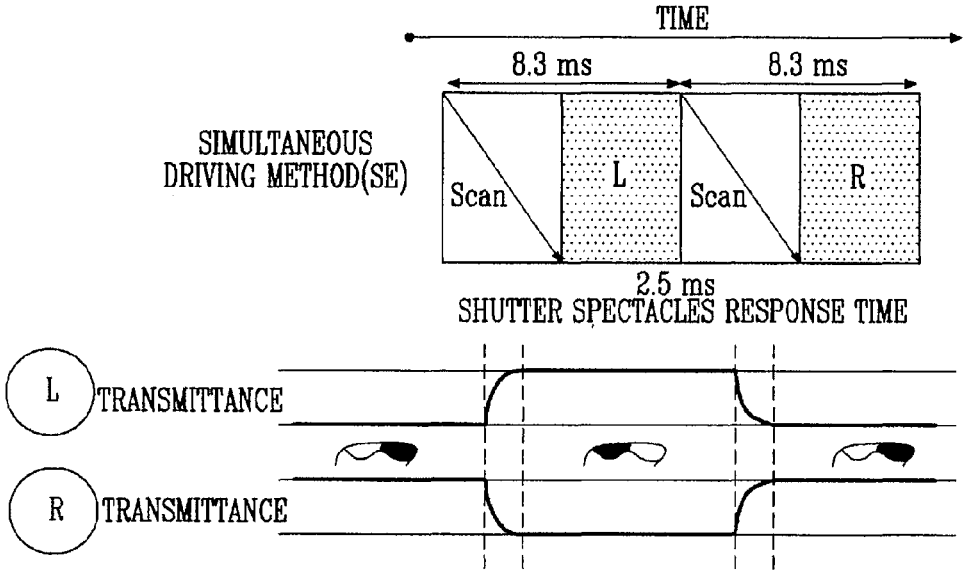
FIG. 4 is a diagram illustrating an example of an operation of a three-dimensional (3D) display using a pair of shutter spectacles according to a concurrent (or simultaneous) emission method according to an embodiment of the present invention.

FIG. 4 is a diagram illustrating an example of an operation of a 3D display using a pair of shutter spectacles in a concurrent (or simultaneous) emission method according to an embodiment of the present invention.

Referring to FIG. 4, in one embodiment, light is concurrently (or simultaneously) emitted from the entire pixel unit, and the pixels are set to a non-emission state in periods other than the emission period, when an image is displayed using the concurrent (or simultaneous) emission method. Therefore, a non-emission period can be located between the left-eye image output period and the right-eye image output period.

That is, the pixels 140 are set to the non-emission state during the scan period between the i-frame and the i+1-frame, and it does not need to specifically reduce the emission duty ratio because the scan period (or the non-emission period) can be synchronized with the response time of the shutter spectacles.

Figure 5:
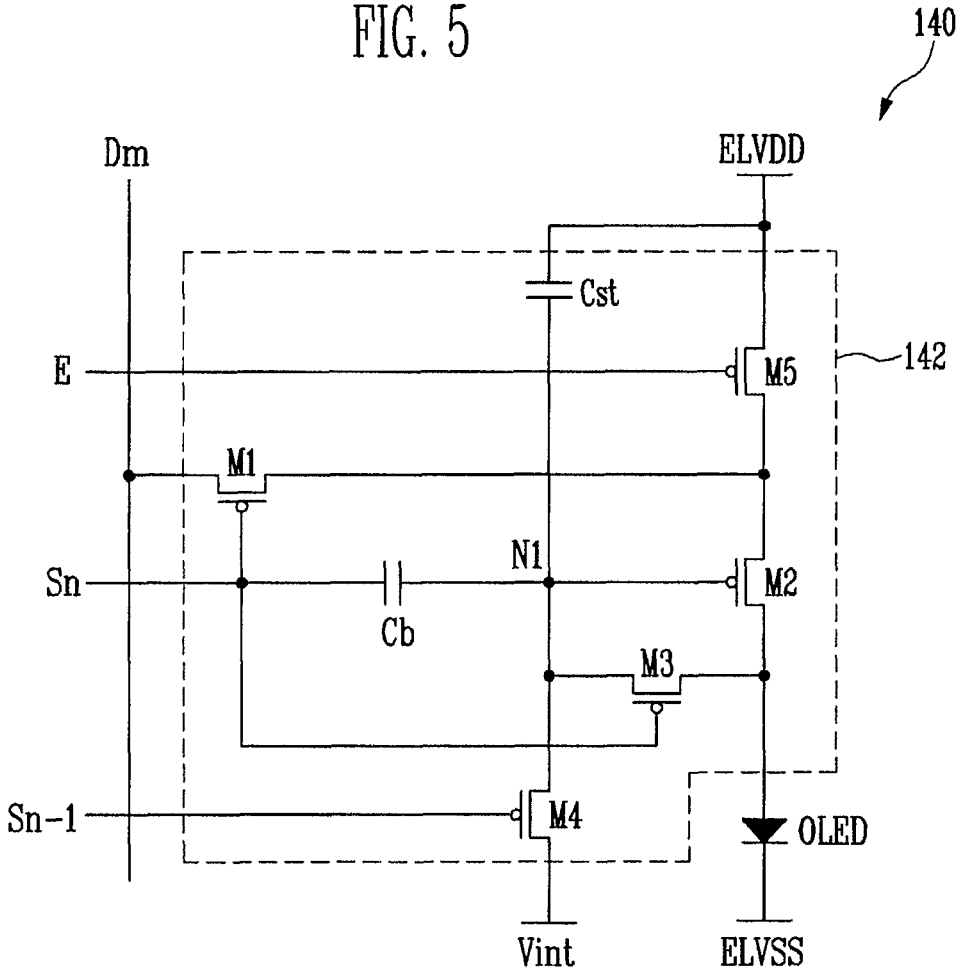
FIG. 5 is a diagram illustrating an embodiment of a pixel shown in FIG. 1.

FIG. 5 is a diagram illustrating an embodiment of a pixel shown in FIG. 1. A pixel coupled with the n-th scan line Sn and the m-th data line Dm is shown in FIG. 5, for convenience of description.

Referring to FIG. 5, the pixel 140 according to an embodiment of the present invention includes an organic light emitting diode OLED and a pixel circuit 142 controlling the amount of current supplied to the organic light emitting diode OLED.

The anode electrode of the organic light emitting diode OLED is coupled to the pixel circuit 142, and the cathode electrode is coupled to the second power supply ELVSS. The organic light emitting diode OLED produces light with a luminance (e.g., a predetermined luminance) in accordance with the amount of current supplied from the pixel circuit 142.

The pixel circuit 142 is charged with a voltage corresponding to the data signal and controls the amount of current supplied to the organic light emitting diode OLED on the basis of the charged voltage. For this operation, the pixel circuit 142 includes first to fifth transistors M1 to M5, a storage capacitor Cst, and a boosting capacitor Cb.

A gate electrode of the first transistor M1 is coupled to the n-th scan line Sn, and a first electrode is coupled to the data line Dm. Further, a second electrode of the first transistor M1 is coupled to a first electrode of the second transistor M2. The first transistor M1 is turned on and electrically connects the data line Dm with the first electrode of the second transistor M2 when a scan signal is supplied to the n-th scan line Sn.

A gate electrode of the second transistor M2 is coupled to a first node N1, and the first electrode is coupled to a second electrode of the fifth transistor M5. Further, a second electrode of the second transistor M2 is coupled to the anode of the organic light emitting diode OLED. The second transistor M2 controls the amount of current supplied to the organic light emitting diode OLED in accordance with the voltage applied to the first node N1.

A first electrode of the third transistor M3 is coupled to the second electrode of the second transistor M2, and a second electrode of the third transistor M3 is coupled to first node N1. Further, a gate electrode of the third transistor M3 is coupled to the n-th scan line Sn. The third transistor M3 is turned on and diode-connects the second transistor M2 when a scan signal is supplied to the n-th scan line Sn.

A first electrode of the fourth transistor M4 is coupled to the first node N1, and a second electrode is coupled to an initialization power supply Vint. Further, a gate electrode of the fourth transistor M4 is coupled to the n−1-th scan line Sn−1. The fourth transistor M4 is turned on and electrically connects the initialization power supply Vint with the first node N1 when the first scan signal is supplied to the n−1-th scan line Sn−1. That is, the first node N1 is initialized to the voltage of the initialization power supply Vint, when the fourth transistor M4 is turned on. In this embodiment, the voltage of the initialization power supply Vint is set lower than the voltages of the data signals.

A first electrode of the fifth transistor M5 is coupled to the first power supply ELVDD, and a second electrode is coupled to the first electrode of the second transistor M2. Further, a gate electrode of the fifth transistor M5 is coupled to an emission control line E. The fifth transistor M5 is turned off when an emission control signal is supplied to the emission control line E and turned on when an emission control signal is not supplied.

The storage capacitor Cst is coupled between the first node N1 and the first power supply ELVDD. In this embodiment, the storage capacitor Cst is charged at a voltage corresponding to a data signal and a threshold voltage of the second transistor M2.

The boosting capacitor Cb is coupled between the scan line Sn and the first node N1. The boosting capacitor Cb increases the voltage of the first node N1 after the storage capacitor Cst is charged with a voltage corresponding to the threshold voltage of the second transistor M2 and the data signals.

Figure 6:
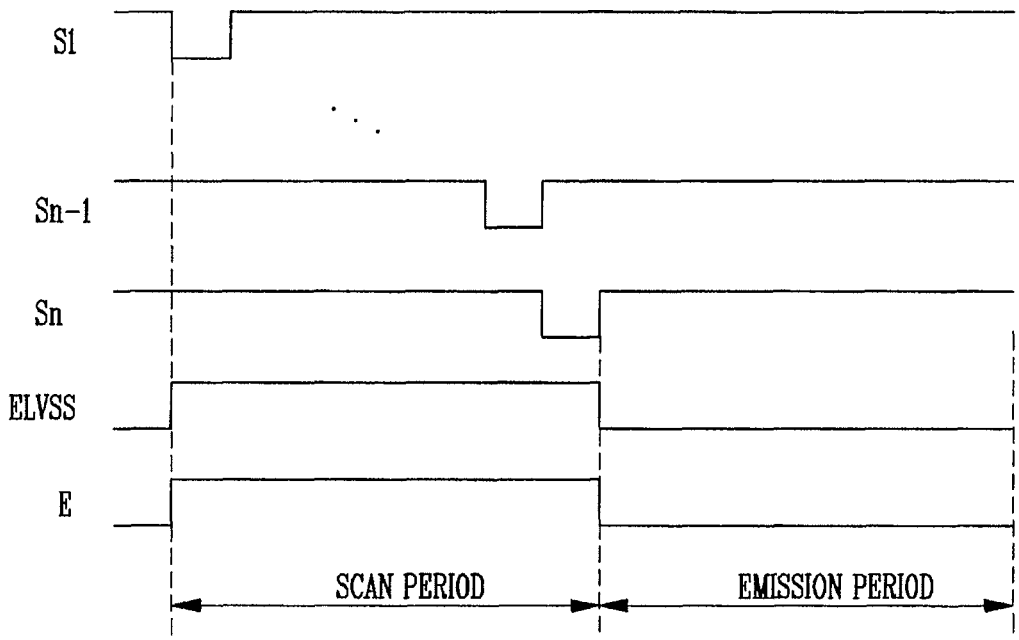
FIG. 6 is a waveform diagram illustrating a method of driving the pixel shown in FIG. 5 according to an embodiment of the present invention.

FIG. 6 is a waveform diagram illustrating a method of driving the pixel shown in FIG. 5 according to one embodiment of the present invention.

Referring to FIG. 6, during the scan period, an emission signal is supplied to the emission control line E and a power of the second power supply is set at a high voltage level.

When the emission control signal is supplied to the emission control line E, the fifth transistors M5 included in the pixels 140 are turned off. In this case, the first power supply ELVDD and the second transistor M2 are electrically disconnected, and accordingly, the pixels 140 are in a non-emission state.

Further, the power of the second power supply ELVSS is supplied at a high voltage level to the cathode electrode of the organic light emitting diode OLED during the scan period. In this configuration, the voltage of the second power supply ELVSS is set at a high voltage level such that current does not flow through the organic light emitting diodes OLED.

Scan signals are sequentially supplied to the scan lines S1 to Sn during the scan period. When a scan signal is supplied to the n−1-th scan line Sn−1, the fourth transistor M4 is turned on. When the fourth transistor M4 is turned on, the voltage of the initialization power supply Vint is supplied to the first node N1.

Thereafter, a scan signal is supplied to the n-th scan line Sn. When the scan signal is supplied to the n-th scan line Sn, the first transistor M1 and the third transistor M3 are turned on. A data signal from the data line Dm is supplied to the first electrode of the second transistor M2 when the first transistor M1 is turned on. The second transistor M2 is diode-connected when the third transistor M3 is turned on. In this process, the second transistor M2 is turned on because the first node N1 is initialized to the voltage of the initialization power supply Vint, which is lower than the voltages of the data lines (e.g., lower than the voltages of the data signals applied to the data lines).

A voltage of the data signal is supplied to the first node N1 when the second transistor M2 is turned on. A voltage obtained by subtracting the absolute value of the threshold voltage of the second transistor from the data signal is applied to the first node N1 because the data signal is supplied to the first node N1 through the second transistor M2, which is diode-connected. In this operation, the storage capacitor Cst is charged with a voltage corresponding to a data signal and the threshold voltage of the second transistor M2.

Thereafter, the supply of a scan signal to the n-th scan line Sn is stopped and accordingly, the voltage of the n-th scan line Sn increases from a low voltage level to a high voltage level. In this process, the boosting capacitor Cb raises the voltage of the first node N1 in accordance with the change in voltage of the n-th scan line Sn. The boosting capacitor Cb makes it possible to display an image with desired luminance by increasing the voltage of the first node N1 by as much as the voltage lost due to charge-sharing between a parasitic capacitance of the data line Dm and the storage capacitor Cst.

During the emission period, an emission control signal is not supplied to the emission control line E and the second power supply ELVSS is set to a low voltage level. During the emission period, the second transistor M2 controls the amount of current flowing from the first power supply ELVDD to the second power supply ELVSS through the organic light emitting diode OLED in accordance with the voltage applied to the first node N1.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device, comprising:

a scan driver for supplying a plurality of scan signals to a plurality of scan lines and for supplying an emission control signal to an emission control line during a scan period in one frame;

a data driver for supplying a plurality of data signals to a plurality of data lines in synchronization with the scan signals;

a second power supply for supplying a second power only at a high voltage level during the scan period and for supplying the second power at a low voltage level during an emission period of one frame period; and a plurality of pixels at crossing regions of the scan lines and the data lines, the pixels being for controlling the amount of current supplied to the second power supply from a first power supply through a plurality of organic light emitting diodes, each of the pixels along an i-th horizontal line, wherein i is a natural number comprising:

a second transistor having a second electrode coupled with an anode electrode of a corresponding organic light emitting diode of the organic light emitting diodes;

a first transistor coupled between a first electrode of the second transistor and a corresponding data line of the data lines, the first transistor being configured to be turned on when a scan signal is supplied to an i-th scan line; and a third transistor coupled between the second electrode of the second transistor and the gate electrode of the second transistor, the third transistor being configured to be turned on when a scan signal of the scan signals is supplied to the i-th scan line.

2. The organic light emitting display device as claimed in claim 1, wherein when the second power supply is set at the high voltage level, current does not flow in the organic light emitting diodes.

3. The organic light emitting display device as claimed in claim 1, wherein the emission control line is coupled to all of the pixels.

4. The organic light emitting display device as claimed in claim 1, wherein the scan driver is configured to not supply the emission control signal to the emission control line during the emission period.

5. The organic light emitting display device as claimed in claim 1, wherein each of the pixels along the i-th horizontal line further comprises:

a fourth transistor coupled between a gate electrode of the second transistor and an initialization power supply, the fourth transistor being configured to be turned on when a scan signal is supplied to an i−1-th scan line of the scan lines;

a fifth transistor coupled between the first electrode of the second transistor and the first power supply, the fifth transistor being configured to be turned off when the emission control signal is supplied to the emission control line;

a storage capacitor coupled between the gate electrode of the second transistor and the first power supply; and a boosting capacitor coupled between the gate electrode of the second transistor and the i-th scan line.

6. The organic light emitting display device as claimed in claim 5, wherein the initialization power supply is configured to supply a voltage at a level lower than that of a data signal of the data signals.

7. A method of driving an organic light emitting display device, the method comprising:

supplying a plurality of scan signals to a plurality of scan lines and an emission control signal to an emission control line during a scan period in one frame;

supplying a plurality of data signals to a plurality of data lines in synchronization with the scan signals;

supplying a second power only at a high voltage level during the scan period and supplying the second power at a low voltage level during an emission period of one frame period;

storing a plurality of voltages in a plurality of pixels along an i-th horizontal line, wherein i is a natural number, each pixel of the pixels storing a voltage of the voltages in accordance with a corresponding data signal of the data signals and a threshold voltage of a second transistor of the pixel, the storing comprising:

applying a data signal of the data signals through a first transistor coupled between a first electrode of the second transistor and a corresponding data line of the data lines when an i-th scan signal of the scan signals is supplied to an i-th scan line; and turning on a third transistor coupled between a second electrode of the second transistor and the gate electrode of the second transistor when the i-th scan signal of the scan signal is supplied to the i-th scan line;

controlling a plurality of currents supplied to a second power supply for supplying the second power from a first power supply through a plurality of organic light emitting diodes of the pixels in accordance with the voltages stored in the pixels.

* * * * *